United States Patent [19]

Eby

[11] 4,381,621

[45] May 3, 1983

[54] TREE STAND

[75] Inventor: Harry S. Eby, Bristol, Ind.

[73] Assignee: Eby's Pines, Inc., Bristol, Ind.

[21] Appl. No.: 294,710

[22] Filed: Aug. 20, 1981

[51] Int. Cl.[3] ..... A01G 9/12

[52] U.S. Cl. ..... 47/40.5; 47/43; 248/121

[58] Field of Search ..... 47/40.5, 42, 43; 248/121, 156

[56] References Cited

U.S. PATENT DOCUMENTS

| | | | |
|---|---|---|---|
| 1,463,734 | 7/1923 | Ullrich . | |
| 2,455,404 | 12/1948 | Brown et al. | 47/40.5 |
| 2,502,040 | 3/1950 | Franklin . | |
| 2,617,617 | 11/1952 | Krastel et al. . | |
| 2,904,292 | 9/1959 | Clouthier . | |
| 3,119,585 | 1/1964 | Austenson | 47/40.5 |
| 4,307,540 | 12/1981 | Reisner | 47/40.5 |

FOREIGN PATENT DOCUMENTS

| | | | |
|---|---|---|---|
| 2618 | of 1900 | United Kingdom | 47/43 |
| 3517 | of 1911 | United Kingdom | 47/43 |
| 1533875 | 11/1978 | United Kingdom | 47/43 |

OTHER PUBLICATIONS

Clouthier Christmas Tree Stands, stands, Lake Linden, Michigan Eby's Pines Floating Base Christmas Tree Stand.

*Primary Examiner*—Robert E. Bagwill
*Attorney, Agent, or Firm*—Marmaduke A. Hobbs

[57] ABSTRACT

A tree stand for supporting a tree such as a Christmas tree in an upright position regardless of the shape and/or size of the tree and/or the tree trunk. The tree stand includes a base member for supporting the stand and a tree, and a freely movable member such as a water pan for receiving the end of the tree trunk. The pan is movable relative to the base member, and a vertical member extends upwardly from the base generally along and near the tree trunk. A trunk engaging means having a portion for receiving the trunk extends outwardly from the vertical member and a securing member is provided for drawing the trunk into the trunk receiving portion. In one embodiment the securing member includes an elastic band which is passed around the tree and attached on its ends to the tree stand, and in another embodiment the securing member includes a hook for engaging the tree and a nut for drawing the hook against the tree and pulling the tree trunk toward the trunk receiving portion.

4 Claims, 7 Drawing Figures

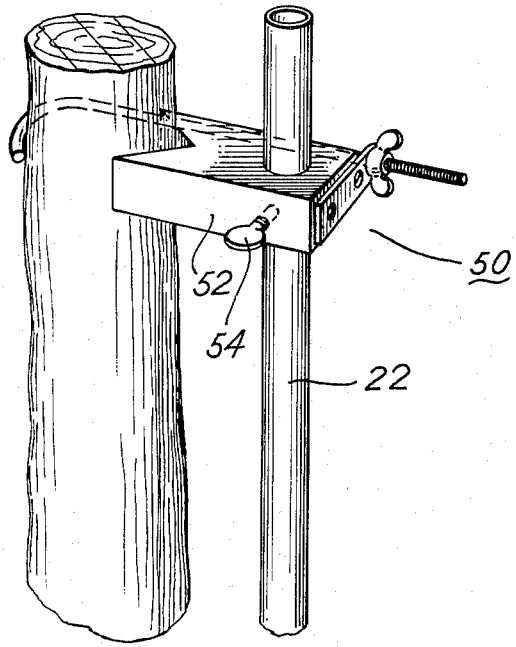
Fig. 6
Fig. 4
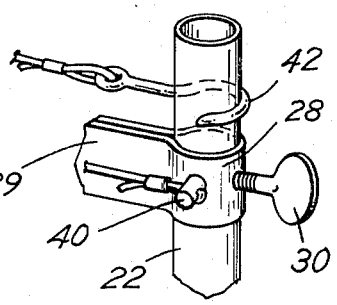
Fig. 5
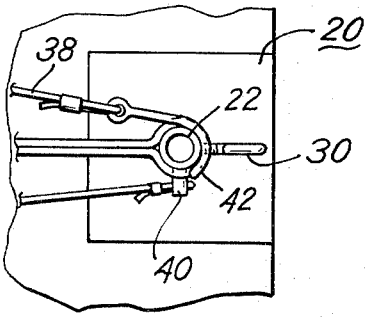
Fig. 7
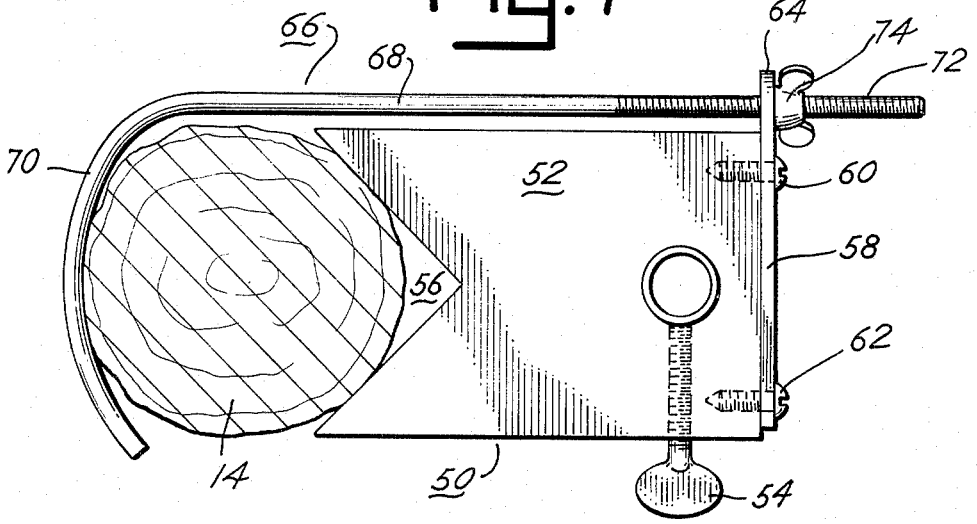

TREE STAND

BACKGROUND OF THE INVENTION

Fresh Christmas trees are used extensively during the Christmas holiday season in homes, public buildings and the like, as decorative centerpieces and as symbols of the holiday spirit. Many different types of stands or support mechanisms are used to hold the trees in upright positions, including bases made of crossed wood members nailed to the bottom of the tree trunk and stands having legs or a base secured to a collar around the tree trunk, or to supports attached by some means to the tree trunk. Most of these types of stands are attached only to the bottom several inches of the tree trunk, below the lowest limbs of the tree, which is often inadequate for effectively stabilizing the tree, especially if the tree is relatively tall or broad. If large base-type stands are used, the collar and angular support members for the base may rise relatively high on the tree trunk, and placement of the collar on the tree trunk requires the removal of lower tree branches. After the lower branches have been removed and the stand has been attached, often the lowest remaining branches on the tree are relatively high off the floor, and a less than desirable appearance is provided by the Christmas tree. If it is desirable to have branches near the ground or floor, a stand of cross members nailed to the bottom of the tree can be used without removing lower tree branches; however, these types of stands do not provide containers for watering the tree. As yet another alternative, if stands having collars on the trees are used, the lower tree limbs can be removed and holes drilled in the trunk of the tree, and the branches can be inserted into the holes after the stand has been attached; however, this is time consuming, and unless the person so altering the tree has experience, the resulting appearance is usually not satisfactory.

Yet another problem encountered in erecting fresh Christmas trees for decorative purposes is that often the trunk of the tree is not straight. This occurs more frequently when the tree is one cut in the wild rather than a cultivated, commercially grown tree. Although the development of the branches on the tree may be such as to provide a symmetric and desirable shape and appearance, the trunk may be angular, curved or otherwise irregular. A stand attached to the bottom of the tree trunk may not support the trunk in the same position as when the tree was growing, and therefore the tree will appear crooked. Still another difficulty is that a bowed or angular trunk results in an unbalanced weight distribution of the tree, and even if the stand can be attached in such a manner that the tree appears straight, the uneven weight distribution results in an unstable arrangement whereby the tree can be toppled easily from the upright position. occassionally a tree of satisfactory appearance will have a thick trunk which will not fit in a stand without whittling or other reduction of the trunk diameter. When the trunk is reduced by hand with a knife, saw or the like, the pitch therefrom can soil floors, carpets, clothes and hands.

Tree stands have been used which have had a water pan at the bottom for steadying the tree trunk and a means for firmly gripping the trunk among the branches a substantial distance above the bottom of the trunk. The gripping means have been difficult to attach to the trunks in that the branches of the tree make it difficult to see the gripping means and complete the attachment.

Two hands are often required to secure the stand to the tree; hence, two people are often needed, one to hold the tree and another to attach the stand.

SUMMARY OF THE INVENTION

It is therefore one of the principal objects of the present invention to provide a tree stand which can be used to support a cut tree of virtually any size, and which provides a stable support for a crooked or irregularly shaped tree so that a tree supported thereby cannot be toppled easily.

Another object of the present invention is to provide a tree stand which provides a brace for a tree relatively high on the trunk, and which requires the removal of only a minimum number of lower branches of the tree for attachment of the stand, thereby providing a stand which will support trees having branches close to the ground.

Still another object of the present invention is to provide a tree stand which can be attached to a fresh Christmas tree quickly and easily with minimal effort, regardless of the shape or size of the tree trunk, and which has a high degree of adjustability for use on trees of different sizes and shapes as well as irregularly shaped trees, permitting adjustment of the tree held thereby after the stand has been attached.

These and other objects are achieved in the present invention by providing a tree stand having a base member for resting on the floor or ground to support the tree and an upright member which extends upwardly along the tree trunk. A trunk engaging member, which preferably is vertically movable on the upright member, extends outwardly from the upright member and can be attached to the trunk of the tree for holding the tree erect. A freely movable pan is disposed on the base member, the lower end of the tree trunk is placed in the pan when the stand is attached to the tree, and water can be placed in the pan for extending the freshness life of the tree. Since it is often difficult to reach the trunk engaging member through the tree branches to attach it to the trunk, a means is provided which can easily and readily be manipulated usually with the one hand, to secure it to the trunk and which will hold the trunk firmly on or against the member.

Further objects and advantages of the present invention will become apparent from the detailed description and the accompanying drawings.

BRIEF DESCRIPTION OF THE DRAWINGS

FIG. 4 is an enlarged perspective view of the area indicated by numeral 4 in FIG. 1;

FIG. 5 is an enlarged view of the area indicated by numeral 5 in FIG. 3;

FIG. 6 is a fragmentary perspective view of a modified form of the tree stand; and FIG. 7 is a top plan view of the tree stand shown in FIG. 6.

DETAILED DESCRIPTION OF THE PREFERRED EMBODIMENT

Figure 1:
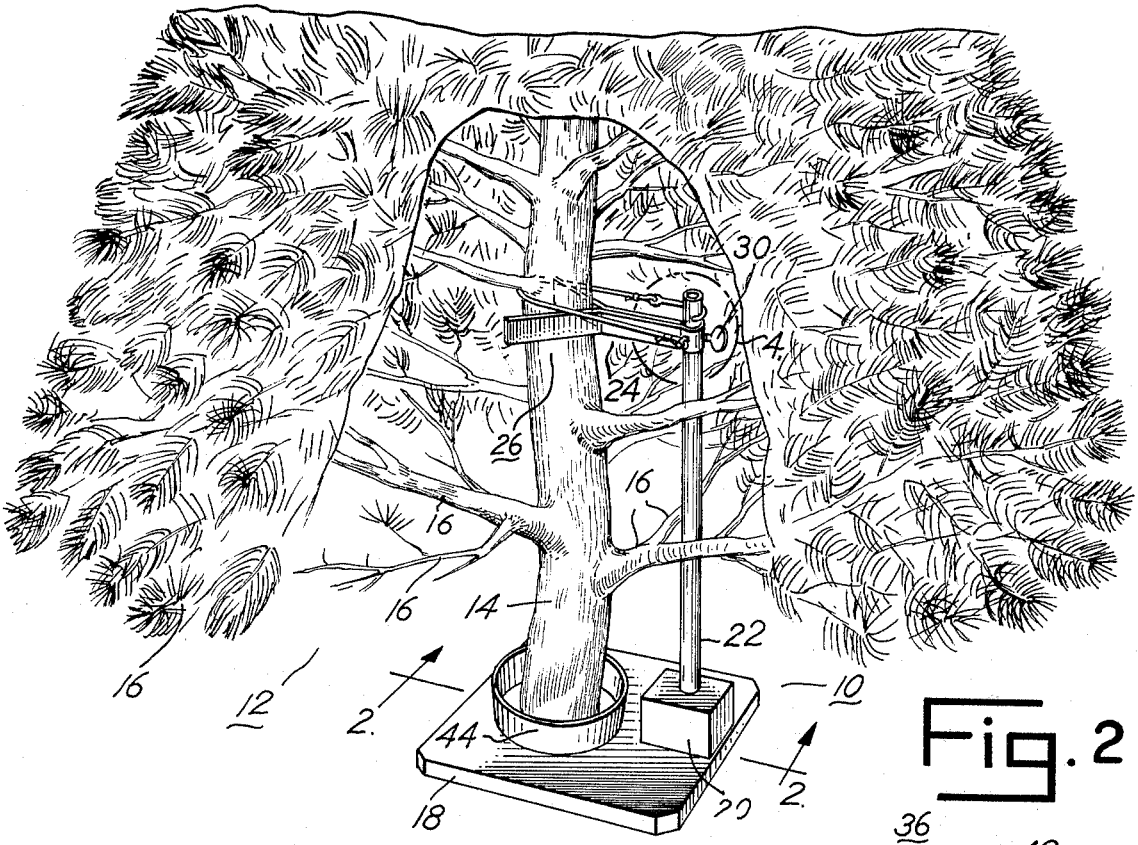
FIG. 1 is a perspective, partially cut-away view of a Christmas tree with a tree stand embodying the present invention for holding the tree in an upright position.
Figure 2:
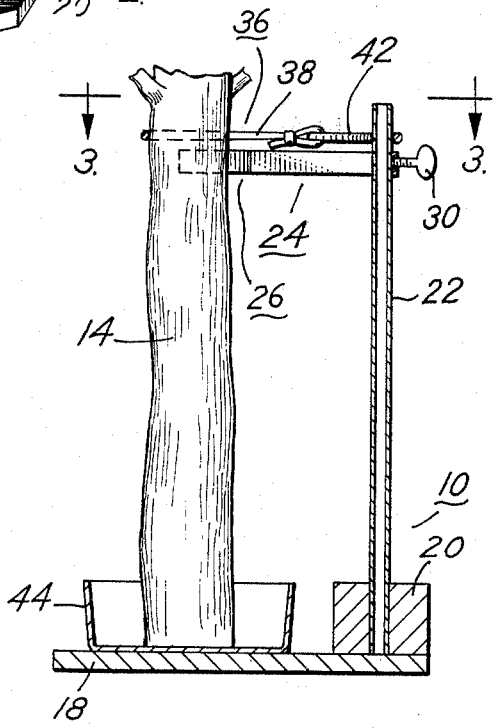
FIG. 2 is a fragmentary vertical cross sectional view of the tree and stand show in FIG. 1, taken on line 2—2 of the latter figure.
Figure 3:
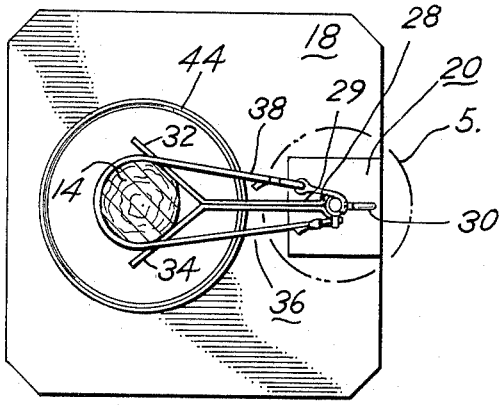
FIG. 3 is a horizontal cross sectional view of the Christmas tree and tree stand shown in the preceding figures, taken on lines 3—3 of FIG. 2.

Referring now more specifically to the drawings, and to FIG. 1 in particular, numeral 10 designates a tree stand embodying the present invention which is shown holding a Christmas tree 12 in an upright position, the tree including a trunk 14 and branches 16. Tree stands embodying the present invention can be made in a variety of different sizes for holding trees of different sizes and types. One of the advantages of the present tree stand is that the stand will hold a tree having a crooked trunk in an upright position and the stand can quickly and easily be attached to trees having irregularly shaped trunks or trunks which are relatively large, without altering the trunk. As shown in FIG. 1, trunk 14 is bowed near the bottom; however, the stand will hold the tree in such a way that the tree will appear straight.

Stand 10 includes a base member 18 which rests on the floor or other surface where the tree is placed and is the bottom supporting member for the tree. The base member may be made of a variety of different materials, and plywood, metal and some plastics are suitable materials. The size of the base member will vary, depending upon the size tree to be supported; however, for average Christmas trees used in the home, a sixteen inch square base of plywood performs satisfactorily in providing a stable base for the tree. A block 20 is disposed near one edge of the base member, generally located equidistant from the ends of the edge, and the block is securely fastened to the base member by nails, screws, glue or other suitably permanent means of attachment. A hole is disposed in the block for receiving a vertical member 22 which extends upwardly from the block, generally along and near the trunk of the tree when the stand is attached to a tree. The vertical member may be a thin walled conduit, a metal pipe, a wooden rod or the like, and the vertical member may be square in cross section or may have cross sectional patterns of other geometric shapes than the circular cross section of the cylindrical vertical member shown; however, for purposes of adjusting the tree stand and suitably positioning the tree, a cylindrical vertical member is preferred, as will be described more fully hereinafter. It should be understood that the vertical member may be attached to base member 18 by means other than block 20 shown. For example, if the base and vertical member are both of metal, the vertical member may be attached directly to the base by welding, brazing or the like. Use of a block 20 on the base has been found to be beneficial in that the block supplies support along the sides of the vertical member. An additional advantage of using a block for holding the vertical member rather than permanently attaching the vertical member to the base is that the vertical member can be removed from the block and base when the stand is stored to provide a compact and easily stored arrangement. The vertical member need not be secured in the hole of the block but can merely be placed therein when the stand is in use, provided that the hole in the block is not appreciably large than the vertical member; however, the block and vertical member can be threaded for fastening the member to the block, or fastening devices can be used if desired.

A trunk engaging means 24 is disposed on vertical member 22 and may be moved upwardly and downwardly thereon to engage the tree trunk at different locations along the length of the trunk. For taller trees it is desirable to engage the trunk farther from base member 18 than for shorter trees. Trunk engaging member 24 includes a generally Y-shaped member 26 having a cylindrical end 28 on the leg section 29 of the member, which can be slid upwardly and downwardly on the vertical member. A thumb-type set screw 30 is disposed in the cylindrical end for securing the Y-shaped member in the selected position along vertical member 22. The end of the Y-shaped member away from vertical member 22 includes arms 32 and 34 which form a crotch in which the trunk of the tree is placed when the stand is attached to a tree. A securing member 36, which can be operated by one person using one hand, holds the trunk tightly in the crotch formed by arms 32 and 34. In the embodiment shown in FIGS. 1 throught 5, the improved, easily operable securing member 36 includes an elastic band 38 which is attached on one end to the cylindrical end 28 of Y shaped member 26 by a screw, rivet or other attachment means 40, and on the distal end of the elastic member a hook 42 is provided for engaging the vertical member, cylindrical end, or the like. The elastic band is stretched around the tree trunk, and hook 42 is normally secured to the vertical member to hold the trunk of the tree tightly in the crotch formed by arms 32 and 34. Attachment of the elastic band can normally be accomplished using only one hand; thus, a person working alone can hold the tree and attach the stand with little or no difficulty. Hook 42 can surround a substantial portion of the vertical member above cylindrical end 28, and once it is attached the hook is not easily dislodged.

A freely movable member, such as a pan 44, is disposed on base member 18 and is movable relative to the base member. The end of the tree trunk is placed in the pan when the stand is attached to the tree, and the pan 44 can be filled with water for keeping the tree fresh. The pan is not secured to the base member and hence can be moved relative to the base member, and the tree can be adjusted as required for presenting a pleasantly appearing straight tree regardless of the shape of the trunk. The pan permits adjustment of the tree after the stand is attached to the tree with the trunk engaging member functioning as a fulcrum about which the upper and lower tree portions pivot.

In the use and operation of a tree stand embodying the present invention, the stand will normally be disassembled when stored so that only a minimal amount of space is required for storing the stand. Hence, when the stand is to be used, vertical member 22 is placed in block 20, and the trunk engaging member 24 is placed on the vertical member, with cylindrical end 28 thereof being disposed around the vertical member. Pan 44 is placed on base 18 and the end of the tree trunk is placed in the pan. Depending on the size of the tree, the trunk engaging member is moved upwardly or downwardly on the vertical member and is secured thereon by set screw 30. On large or tall trees the vertical member extends upwardly a substantial distance among the branches of the tree, and the trunk engaging member is placed thereon after the tree is initially positioned on the stand, so that the branches of the tree will not interfere with the positioning of the engaging member near the top of the vertical member. After the trunk engaging member is securely attached to the vertical member by tightening set screw 30, the trunk is pulled into the crotch formed by arms 32 and 34, and elastic band 38 is stretched around the trunk of the tree. Hook 42 is engaged around the vertical member, or may be connected to the trunk engaging member near the vertical member thereby holding the trunk of the tree securely in the crotch formed by arms 32 and 34. A round vertical member and a cylindrical end 28 on the trunk engaging member are the preferred designs in that, if the trunk is crooked, it may be desirable to move the trunk engaging member in a horizontal plane about the vertical member to properly position the tree for the best support. In this way the weight of the tree can be centered over the base member regardless of the position of the end of the trunk. Once the tree is securely held in the trunk engaging member, the tree can be straightened merely by grasping the tree and pulling or pushing the tree in the desired directions until the tree appears straight. The bottom end of the tree trunk, being disposed in pan 44 which floats on base 18, can move relative to the base when the tree is straightened. Thus, the trunk engaging member provides a pivot point for the trunk of the tree, and the portions of the tree above and below the trunk engaging member can be moved as required for straightening the tree. If necessary, the trunk can be moved slightly in the crotch formed by arms 32 and 34 even when the securing member 36 has been tightened against the tree trunk. The stand will hold the tree securely after it has been properly positioned, in that the bottom of the tree is placed in the pan on the base member, and the trunk engaging member 24 restricts the tree from tipping in any direction. Thus, as shown in FIG. 1, when a tree has a relatively crooked trunk, it can still be held vertically by the present tree stand in that the straightness of the trunk has no effect on the attachment of the stand to the trunk. If a stand which attached directly to the lower end of the trunk were used with the tree shown in FIG. 1, the stand would require complicated adjustments on the lower end of the trunk until the tree appeared straight. The present tree stand allows for quick and easy attachment of the tree to the stand and for adjustment of the tree merely by pushing or pulling the tree after it has been placed in an upright position. One person working alone can attach the present stand to a tree and can adjust the tree as required. To straighten a tree held by previous stands, two people are often required, one to hold the tree and another to loosen, adjust the tighten the stand. The stand also can be used on various size tree trunks in that the crotch formed by arms 32 and 34 will hold small and large trunks therein and modifications to the trunks are not required.

Various other types of trunk engaging means may be used on the present tree stand. For example, a trunk engaging member 50 is shown in FIGS. 6 and 7 which is slightly different from that shown in the preceeding Figures. Member 50 includes an arm 52 of wood, metal, plastic or the like having a hole therein for receiving vertical member 22. A set screw 54 is disposed in the arm and may be tightened against the vertical member when the vertical member is diposed in the arm. Thus, the arm can be moved upwadly or downwardly on the vertical member and secured in the selected position. A V-shaped opening 56 is disposed in the end of arm 52 for receiving trunk 14 of the tree. A plate 58 is attached to the end of the arm opposite opening 56, and, if the arm is of wood, plastic or the like, the plate may be secured thereto by screws 60 and 62. It should be understood that the plate and arm may be made as an integral unit rather than as separate pieces secured to each other. An end 64 of plate 58 extends outwardly past one side edge of arm 52, and has a hole therein for receiving a securing member 66. In this embodiment the securing member comprises a generally hook shaped bar or rod 68 having a curved end 70 for extending around the side of the tree trunk opposite the side disposed in opening 56. The rod extends downwardly along arm 52 and has a threaded end 72 which may slide through an opening in end 64 of plate 58. A nut 74 which preferably is a wing nut engages the threads on threaded end 72 on the opposite side of plate 58 from hooked end 70. When the stand is attached to a tree, arm 52 is adjusted on vertical member 22 to the desired height and the tree trunk is placed in V-shaped opening 56. Threaded end 72 of rod 68 is placed in the opening of bar 58 and nut 74 is threaded onto the thread end and is adjusted thereon to pull curved end 70 against the tree trunk and to pull the trunk into opening 56. By tightening nut 74, the tree trunk can be held tightly in opening 56. The remainder of the stand is similar to that described previously, and operation of the tree stand for adjusting the position of the tree is the same as that described previously. Attachment of this modified form of stand can also be completed quickly and easily by one person acting alone, and the branches of the tree do not interfere appreciably with attachment of the stand.

The trunk engaging members of either of the embodiments disclosed herein will tightly grasp the tree trunk a substantial distance from the end of the trunk and can be attached to the trunk among the branches without removing branches. Thus, the lowermost branches of the tree need not be removed, and branches on the tree will almost completely conceal the stand.

Although one embodiment and a modification for a tree stand have been shown and described in detail herein, various other changes may be made without departing from the scope of the present invention.

I claim:

1. A tree stand comprising a base member for supporting the stand and a tree attached thereto and having a water container for receiving the end of the trunk of the tree, a vertical member extending upwardly from said base member near the trunk of the tree, trunk engaging means extending outwardly from said vertical member including a member on said engaging means for receiving the trunk of the tree and preventing lateral movement of the trunk, and securing means for pulling the trunk into said receiving member, said securing means including an elastic band fixed on one end to said engaging member and having a hook on the other end for connecting to the vertical member after the band has been passed around the tree trunk.

2. A tree stand as defined in claim 1 in which said water container is a pan for holding water to extend the freshness life of the tree.

3. A tree stand as defined in claim 2 in which said engaging means is vertically adjustable on said vertical member.

4. A tree stand as defined in claim 1 in which said engaging means is vertically adjustable on said vertical member.

* * * * *